US011515663B2

(12) United States Patent
Whitley et al.

(10) Patent No.: US 11,515,663 B2
(45) **Date of Patent: *Nov. 29, 2022**

(54) ELECTRICAL CONNECTOR FOR OILFIELD OPERATIONS

(71) Applicant: Sonic Connectors Ltd., Odessa, TX (US)

(72) Inventors: Brody Whitley, Midland, TX (US); Matt Duckworth, Odessa, TX (US)

(73) Assignee: SONIC CONNECTORS LTD., Odessa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/575,213

(22) Filed: Jan. 13, 2022

(65) Prior Publication Data

US 2022/0140525 A1 May 5, 2022

Related U.S. Application Data

(63) Continuation of application No. 17/024,204, filed on Sep. 17, 2020, now Pat. No. 11,251,563.

(51) Int. Cl.

| | |
|---|---|
| ***H01R 13/46*** | (2006.01) |
| ***H01R 13/533*** | (2006.01) |
| ***E21B 17/02*** | (2006.01) |
| ***H01R 13/04*** | (2006.01) |
| ***H01R 13/405*** | (2006.01) |
| ***H01R 13/52*** | (2006.01) |
| ***H01R 24/84*** | (2011.01) |

(52) U.S. Cl.

CPC ..... *H01R 13/533* (2013.01); *E21B 17/028* (2013.01); *H01R 13/04* (2013.01); *H01R 13/405* (2013.01); *H01R 13/5202* (2013.01); *H01R 24/84* (2013.01)

(58) Field of Classification Search

CPC ..... H01R 13/533; H01R 13/46; H01R 13/04; H01R 13/02; H01R 13/005; H01R 13/10; H01R 13/422; H01R 13/5202; H01R 13/52; H01R 24/84; E21B 17/28

USPC ..... 439/498, 733.1, 533

See application file for complete search history.

(56) References Cited

U.S. PATENT DOCUMENTS

| | | | |
|---|---|---|---|
| 3,066,272 | A | 11/1962 | Quackenbush |
| 3,336,569 | A | 8/1967 | Nava |
| 3,391,381 | A | 7/1968 | Livingston |
| 3,953,099 | A | 4/1976 | Wilson |

(Continued)

*Primary Examiner* — Harshad C Patel

(74) *Attorney, Agent, or Firm* — Baker & McKenzie

(57) ABSTRACT

An electrical connector is provided that includes a plurality of electric cables. A first adapter is configured to receive the electrical cables. The first adapter protects the electrical cables and allows for an electrical connection between the electrical cables and a plurality of electrical pins. A second adapter is coupled to the first adapter. The second adapter allows for an electrical connection between the electrical pins and a plurality of electrical terminals. A cable kit is provided that is at least partially housed within the second adapter. The cable kit has a plurality of projections extending therefrom. An insulator body is coupled to the second adapter. The insulator body includes a plurality of openings. Each of the openings has a tapered end portion configured to receive a corresponding one of the plurality of projections of the cable kit to form a mechanical seal with the cable kit.

13 Claims, 4 Drawing Sheets

(56) References Cited

U.S. PATENT DOCUMENTS

| | | | | |
|---|---|---|---|---|
| 4,133,593 | A | 1/1979 | Moulin | |
| 4,310,213 | A | 1/1982 | Fetterolf, Sr. et al. | |
| 4,531,798 | A | 7/1985 | Baur et al. | |
| 4,857,008 | A | 8/1989 | Kee et al. | |
| 5,595,497 | A | 1/1997 | Wood | |
| 5,803,771 | A | 9/1998 | Knapp | |
| 5,890,925 | A | 4/1999 | Bernardini | |
| 6,942,516 | B2 | 9/2005 | Shimoyama et al. | |
| 7,033,193 | B2 | 4/2006 | Higgins et al. | |
| 7,195,505 | B1 | 3/2007 | Becker | |
| 7,422,463 | B2 | 9/2008 | Kuo | |
| 7,901,240 | B2 | 3/2011 | Jackson et al. | |
| 8,192,216 | B1 | 6/2012 | Puluc et al. | |
| 8,328,574 | B1 | 12/2012 | Lin | |
| 9,368,907 | B2 | 6/2016 | Becker | |
| 10,128,613 | B2 | 11/2018 | Yang | |
| 11,251,563 | B1 * | 2/2022 | Whitley | H01R 24/84 |
| 2010/0136819 | A1 | 6/2010 | Mase et al. | |
| 2013/0217277 | A1 | 8/2013 | Friese et al. | |
| 2018/0131129 | A1 | 5/2018 | Plested et al. | |

* cited by examiner

ELECTRICAL CONNECTOR FOR OILFIELD OPERATIONS

CROSS REFERENCE TO RELATED APPLICATIONS

This application is a continuation application of U.S. Nonprovisional application Ser. No. 17/024,204 filed on Sep. 17, 2020, the disclosure of which is hereby incorporated by reference in its entirety.

BACKGROUND

Drilling operations continually occur at great depths, where the pressure is increased on the equipment used for drilling. One of the main reasons drilling equipment fails is that electrical connectors are exposed to well fluid intrusion, heat, and poor insulation due to pressure, temperature, and well fluid. In addition to the effect of fluid intrusion, resulting in electric shorts between the connector's pins, the connector's geometry and materials contribute to the occurrence of electric shorts. The high voltages/currents, the short distance between pins, and the presence of well fluids significantly increase the risk for electrical shorts.

A new approach to addressing these issues is presented herein.

BRIEF SUMMARY

According to one aspect of the subject matter described in this disclosure, an electrical connector is provided. The electrical connector includes a plurality of electric cables, and a first adapter being configured to receive the electrical cables. The first adapter protects the electrical cables and allows for an electrical connection between the electrical cables and a plurality of electrical pins. A second adapter is coupled to the first adapter. The second adapter allows for an electrical connection between the electrical pins and a plurality of electrical terminals. A cable kit is provided that is at least partially housed within the second adapter. The cable kit has a plurality of projections extending therefrom. An insulator body is coupled to the second adapter. The insulator body includes a plurality of openings. Each of the openings has a tapered end portion configured to receive a corresponding one of the plurality of projections of the cable kit to form a mechanical seal with the cable kit.

According to another aspect of the subject matter described in this disclosure, a method of manufacturing an electrical connector is provided. The method includes providing a plurality of electrical cables, and receiving the electrical cables using a first adapter. The first adapter protects the electrical cables and allows for an electrical connection between the electrical cables and a plurality of electrical pins. Also, the method includes coupling a second adapter to the first adapter, the second adapter allowing for an electrical connection between the electrical pins and a plurality of electrical terminals. The method further includes positioning a cable kit at least partially within the second adapter. The cable kit has a plurality of projections extending therefrom. Further, the method includes coupling an insulator body to the second adapter, the insulator body including a plurality openings. Each of the openings has a tapered end portion to receive a corresponding one of the plurality of projections to form a mechanical seal.

According to another aspect of the subject matter described in this disclosure, an electrical connector is provided. The electrical connector includes a plurality of electric cables and a first adapter being configured to receive the electrical cables. The first adapter protects the electrical cables and allows for an electrical connection between the electrical cables and a plurality of electrical pins. A second adapter is coupled to the first adapter, wherein the second adapter houses a cable kit allowing for an electrical connection between the electrical pins and the electrical cables. The cable kit has a plurality of projections extending therefrom. An insulator body is at least partially positioned within the second adapter and includes a plurality of openings at a first end thereof. Each of the openings has a tapered end portion configured to receive a corresponding one of the plurality of projections.

Additional features and advantages of the present disclosure are described herein, and will be apparent from, the detailed description of this disclosure.

BRIEF DESCRIPTION OF THE DRAWINGS

The disclosure is illustrated by way of example, and not by way of limitation, in the figures of the accompanying drawings in which like reference numerals are used to refer to similar elements. It is emphasized that various features may not be drawn to scale and the dimensions of various features may be arbitrarily increased or reduced for clarity of discussion.

DETAILED DESCRIPTION

Figure 1:
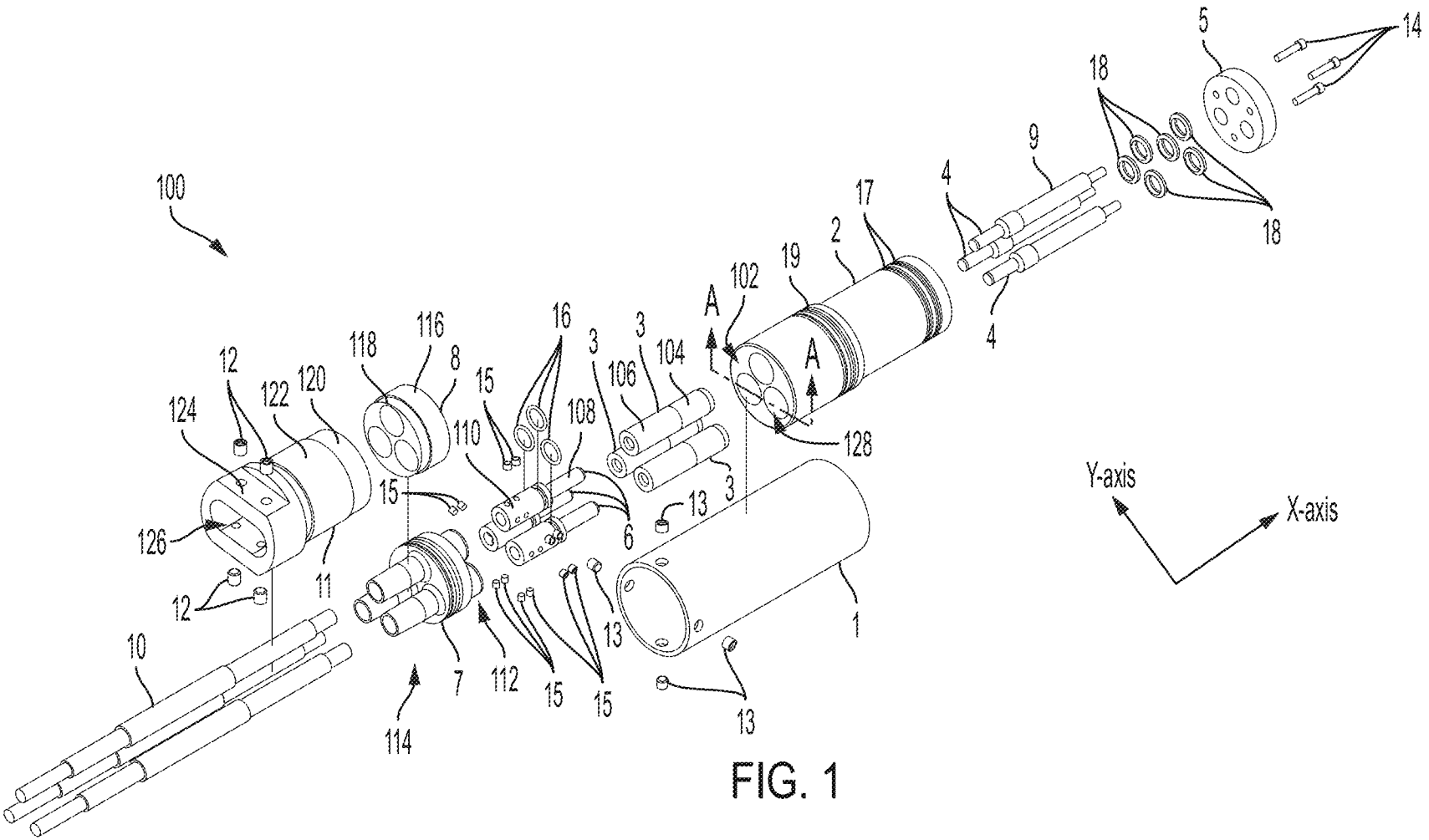
FIG. 1 illustrates an exemplary embodiment of an electrical connector, in accordance with some embodiments.

The figures and descriptions provided herein may have been simplified to illustrate aspects that are relevant for a clear understanding of the herein described devices, systems, and methods, while eliminating, for the purpose of clarity, other aspects that may be found in typical similar devices, systems, and methods. Those of ordinary skill may recognize that other elements and/or operations may be desirable and/or necessary to implement the devices, systems, and methods described herein. But because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

The terminology used herein is for the purpose of describing particular example embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another element, component, region, layer or section. That is, terms such as "first," "second," and other numerical terms, when used herein, do not imply a sequence or order unless clearly indicated by the context.

Reference in the specification to "one implementation" or "an implementation" means that a particular feature, structure, or characteristic described in connection with the implementation is included in at least one implementation of the disclosure. The appearances of the phrase "in one implementation," "in some implementations," "in one instance," "in some instances," "in one case," "in some cases," "in one embodiment," or "in some embodiments" in various places in the specification are not necessarily all referring to the same implementation or embodiment.

The disclosure presents a novel design for an electrical connector requiring subsea connections and submersible pump connections. In particular, the disclosure describes an electrical connector that can handle the physical elements that deteriorate standard electrical connectors, such as high temperature, high pressure, and abrasive and/or corrosive fluids, including liquids and gases. Moreover, the compact design described in the disclosure allows the electrical connector to apply easily across multiple types of equipment, requiring subsea electrical connections and/or submersible pump electrical connections. Moreover, the disclosure describes an electrical connector with an insulator body having a number of openings where each of the openings has tapered ends. The electrical connector according to the present disclosure further describes a cable kit that can couple to the insulator body at the tapered ends of the insulator body, thus forming a mechanical seal. In other words, the electrical connector does not rely on downhole pressure to form the seal. Rather, when the components of the electrical connector described herein are assemble, the cable kit, which is formed of rubber, expands thus completing the desired seal. The seal may protect the electrical connections in the electrical connector from harmful elements, such as fluid intrusion, gas intrusion, debris, or the like.

FIG. 1 illustrates an exemplary embodiment of an electrical connector 100, in accordance with some embodiments. In particular, electrical connector 100 includes an adapter 1 that may be formed of a polyether ether ketone (PEEK) material. The adapter 1 defines a body/housing for which most of the components of the electrical connector 100 are contained within. PEEK adapter 1 may extend in the horizontal (X-axis) direction, and several screws 13 are positioned on one end of adapter 1. Screws 13 are used to tightly adhere adapter 1 to the components stored therein. In some embodiments, screws 13 may be positioned on a different end of the adapter 1. In some embodiments, screws 13 may be positioned on both peripheral ends of the adapter 1. In some implementations, the number of screws 13 shown in FIG. 1 can vary depending on the equipment used.

Electrical connector 100 includes an insulator body 2 that may be sized and positioned within adapter 1. Insulator body 2 may be a solid insulator structure having a cylindrically-shaped body extending horizontally in the X-axis direction. Moreover, insulator body 2 may include many cylindrically-shaped openings 102 defined in the interior of the insulator body. Cylindrically-shaped openings 102 extend horizontally in the X-axis direction in the interior of insulator body 2. Moreover, insulator body 2 may include openings that are tapered at ends thereof in order to cooperate with a cable kit to form a seal as will be described further in conjunction with FIG. 3 below. The exterior surface of insulator body 2 may include a first set of O-rings 17 and a second set of O-rings 19. In some implementations, the first set of O-rings 17 and second set of O-rings 19 may include a rust-resistant metal material. In some embodiments, the first set of O-rings 17 and second set of O-rings 19 may be formed of a plastic material. In some embodiments, the first set of O-rings 17 and second set of O-rings 19 may be attached to insulator body 2 using an adhesive. In some embodiments, first set of O-rings 17 and second set of O-rings 19 may be fabricated on insulator body 2. In some embodiments, the number of cylindrically-shaped openings 102 shown in FIG. 1 may vary depending on the application and equipment being used.

Moreover, electrical connector 100 may include several electrical terminals 4 and armored cables 9. Electrical terminals 4 are hollow-shaped cylindrical structures that extend horizontally in the X-axis direction. Armored cables 9 are also hollow-shaped cylindrical structures that extend horizontally in the X-axis direction. Each of the electrical terminals 4 is sized and shaped to be positioned in the interior region of an armored cable 9. Moreover, the lengths of electrical terminals 4 may be longer than the lengths of armored cables 9 leaving a portion of electrical terminals 4 extending outward of armored cables 9.

A circular compression plate 5 may securely couple electrical terminals 4 and armored cables 9 in conjunction with insulator body 2. Circular compression plate 5 may be a solid metal structure having several holes defined in its interior region that are sized to allow the connected electrical terminals 4 and armored cables 9 to pass therethrough. Additional holes may be defined in the compression plate 5 to enable several screws 14 to securely lock the compression plate 5 with the insulator body 2.

In some implementations, compression plate 5 may be formed of plastic materials. In some embodiments, compression plate 5 may include materials that sustain high pressure and/or prevent fluid intrusion.

Electrical connector 100 may include multiple pin inserts 3 and electrical pins 6. Pin inserts 3 may include hollow-shaped cylindrical structures 104, 106 extending horizontally along the X-axis direction. Also, electrical pins 6 may include hollow-shaped cylindrical structures 108, 110 extending horizontally along the X-axis direction. Each pin insert 3 may have a first section 104 and a second section 106. Each electrical pin 6 may include a first section 108 and a second section 110. Each first section 104 of pin inserts 3 may be coupled to one of the electrical terminals 4. Each second section 106 of pin inserts 3 may be coupled to one of the electrical pins 6. Electrical pin inserts 3 facilitate an electrical connection between each of the electrical terminals 4 and the electrical pins 6. Also, electrical pin inserts 3 are positioned within insulator body 3 protecting the electrical connections between electrical terminals 4 and electrical pins 6.

In some embodiments, first portions 104 and second portions 106 of pin inserts 3 may have different materials.

Each first portion 108 of electrical pins 6 may be coupled to one of the second portions 106 of pin inserts 3. The diameters of the second section 106 of pin inserts 3 may be larger than the diameters of electrical pins 6 to accommodate the pins within the pin inserts. The cylindrical size of the second portion 110 of electrical pin 6 may be larger than the cylindrical size of the first portion 108 of electrical pin 6. The second portion 110 of electrical pin 6 may include openings for one or more screws 15. Each second portion 110 of electrical pins 6 may be coupled to one of the multiple electric cables 10 via a cable kit 7. Screws 15 may be used to secure each of the electrical cables 10 with its respective second portion 110 of electrical pins 6.

Cable kit 7 may be configured to protect electrical cables 10 and its various connections with electrical pins 6. Electrical cables 10 extend horizontally in the X-axis direction. Also, cable kit 7 may include a first set of projections 112 extending in a first direction towards insulator body 2 and a second set of projections 114 extending in a direction opposite the first direction. The first set of projections 112 define cylindrical openings allowing each of the second portions 110 of pin inserts 3 to be substantially positioned inside cable kit 7 to facilitate an electrical connection between pins 6 and electric cables 10. In one embodiment, the first set of projections 112 define cylindrical openings having a substantially constant diameter such that the first set of projections are also substantially constant in diameter, thus resulting in substantially straight projections with little to no variations in diameter. The second set of projections 114 define cylindrical openings allowing each of the electrical cables 10 to be substantially positioned inside cable kit 7 to establish an electrical connection with the pins 6.

The length of each of the second set of projections 114 of cable kit 7 may be longer than the length of each of the first set of projections 112. In some implementations, the length of each of the second set of projections 114 and each of the first set of projections 112 of the cable kit 7 are the same. In some embodiments, the length of each of the first set of projections 112 may be longer than the lengths of each of the second set of projections 114.

In some embodiments, the cable kit 7 is formed of rubber to facilitate a mechanical seal with the insulator body 2 as will be described. In other implementations, the first set of projections 112 of cable kit 7 may be formed of different materials from the remaining portions of cable kit 7. In some embodiments, the second set of projections 114 of cable kit 7 may be formed of different materials from the remaining portions of cable kit 7. Indeed, in some embodiments, the first set of projections 112 may be formed in a separate piece of material than the piece of material having the second set of projections. In such embodiments, the two pieces of material may couple together upon assembly of the electrical connector 100.

A follower 8 may be provided adjacent to the cable kit 7. The follower may be a solid circular metallic structure having several holes in its interior region for allowing each of the second set of openings 114 of cable kit 7 to pass therethrough. Also, follower 8 may include a first portion 116 and a second portion 118. First portion 116 of follower 8 may have a larger diameter and surface area than second portion 118 of follower 8.

In some implementations, follower 8 may include may include plastic materials. In some embodiments, follower 8 may include materials that sustain high pressure and/or prevent fluid intrusion.

In some implementations, first portion 116 of follower 8 may include different materials from the remaining portions of follower 8.

Armor adapter 11 may be configured to protect the connections between electrical cables 10 and electric pins 6 via the second openings 114 of cable kit 7. Also, armor adapter 11 may enclose a portion of the second set of projections 114 of cable kit 7 and electrical cables 10. Armor adapter 11 may include a first portion 120, a second portion 122, and a third portion 124. First portion 120 of adapter 11 may be a hollowed-shaped cylindrical structure extending horizontally in the X-axis direction. The radial size of first portion 120 of armor adapter 11 may allow for second portion 118 of follower 8, including second openings 114 of cable kit 7 to fit inside the first portion 120 of armor adapter 11.

Second portion 122 of armor adapter 11 may be a hollow cylindrical structure extending horizontally in the X-axis direction. The radial size of second portion 122 of armor adapter 11 may allow for second portion 118 of follower 8, including the second set of projections 114 of cable kit 7 and electrical cables 10 to fit inside the second portion 122 of armor adapter 11. The length of second portion 122 of armor adapter 11 is longer than that of first portion 120 of armor adapter 11. Also, second portion 122 of armor adapter 11 may connect the first portion 120 of armor adapter 11 to the third portion 124 of armor adapter 11.

Third portion 124 of armor adapter 11 may be a hollow elliptical-shaped structure extending horizontally in the X-axis direction. Also, an opening 126 defined in the interior region of third portion 124 of armor adapter 11 may receive electrical cables 10. Screws 12 may be positioned on the top and bottom surfaces of third portion 124 of armor adapter 11 to fasten and set electrical cables 10 in the third portion 124 of armor adapter 11.

In some implementations, armor adapter 11 may include metallic materials. In some embodiments, armor adapter 11 may include plastic materials. In some embodiments, armor adapter 11 may include materials that sustain high pressure and/or prevent fluid intrusion.

In some implementations, first portion 120 of armor adapter 11 may include different materials from the remaining portions of armor adapter 11. In some embodiments, second portion 122 of armor adapter 11 may include different materials from the remaining portions of armor adapter 11. In some embodiments, third portion 124 of armor adapter 11 may include different materials from the remaining portions of armor adapter 11.

Figure 2:
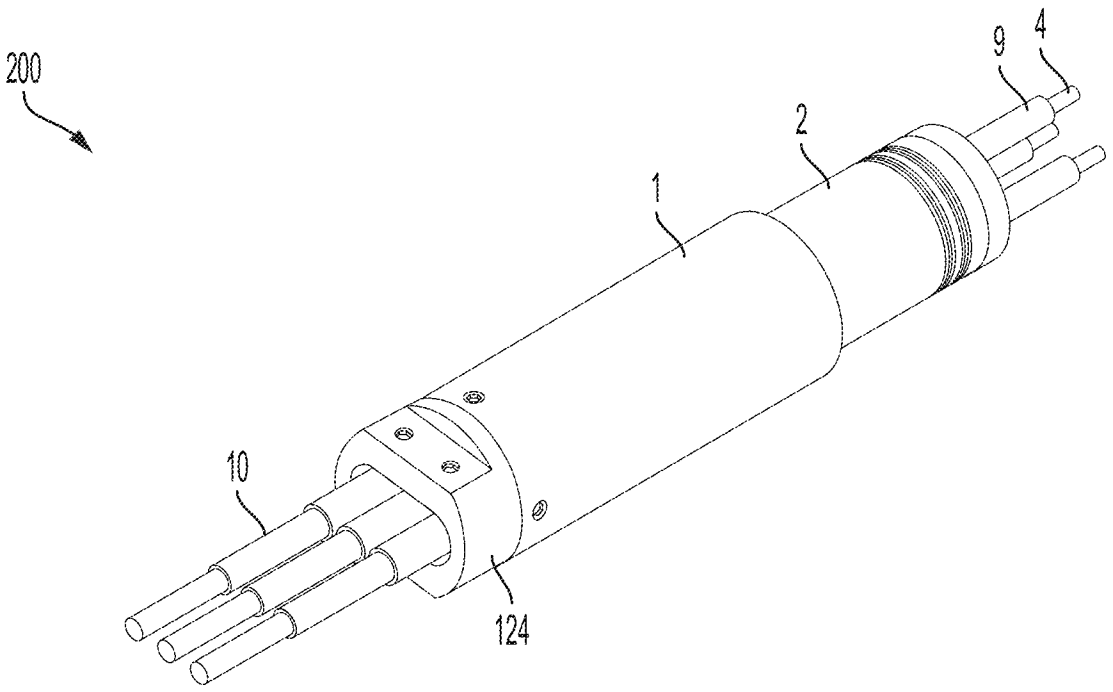
FIG. 2 illustrates an exemplary embodiment of an assembled electrical connector, in accordance with some embodiments.

FIG. 2 illustrates an exemplary embodiment of an assembled electrical connector 200, in accordance with some embodiments. Assembled electrical connector 200 includes the same components described for electrical connector 100 of FIG. 1. Note the same numbering of the components of electrical connector 100 of FIG. 1 is applied to assembled electrical connector 200 of FIG. 2. As shown in FIG. 2, the third portion 124 of armor adapter 11 may receive electrical cables 10 via the opening 126 (shown in FIG. 1). Also, adapter 1 may enclose part of the armor adapter 11. Peek adapter 1 may enclose a part of insulator body 2, as shown in FIG. 2. As discussed herein, insulator body 2 includes multiple openings 102 (shown in FIG. 1) allowing a portion of the armored cables 9 and electrical terminals 4 to be exposed at one end of insulator body 2.

As shown in FIG. 1, many components are contained within adapter 1, including cable kit 7, electrical inserts 3, electrical pins 6, and parts of armor adapter 11 and respective other components, as shown in FIG. 1. The assembled electrical connector 200 may establish an electrical connection by connecting the electrical terminals 4 to an on-land electrical power source and the electrical cables 10 may provide an electrical connection to downhole instruments in a wellbore.

In some implementations, electrical terminals 4 may be connected to a diesel turbine engine. In some embodiments, electrical terminals may be connected to a gas turbine engine.

In some implementations, electrical cables 10 may be connected to one or more submersible pumps. In some embodiments, electrical cables 10 may be connected to drilling equipment.

Figure 3:
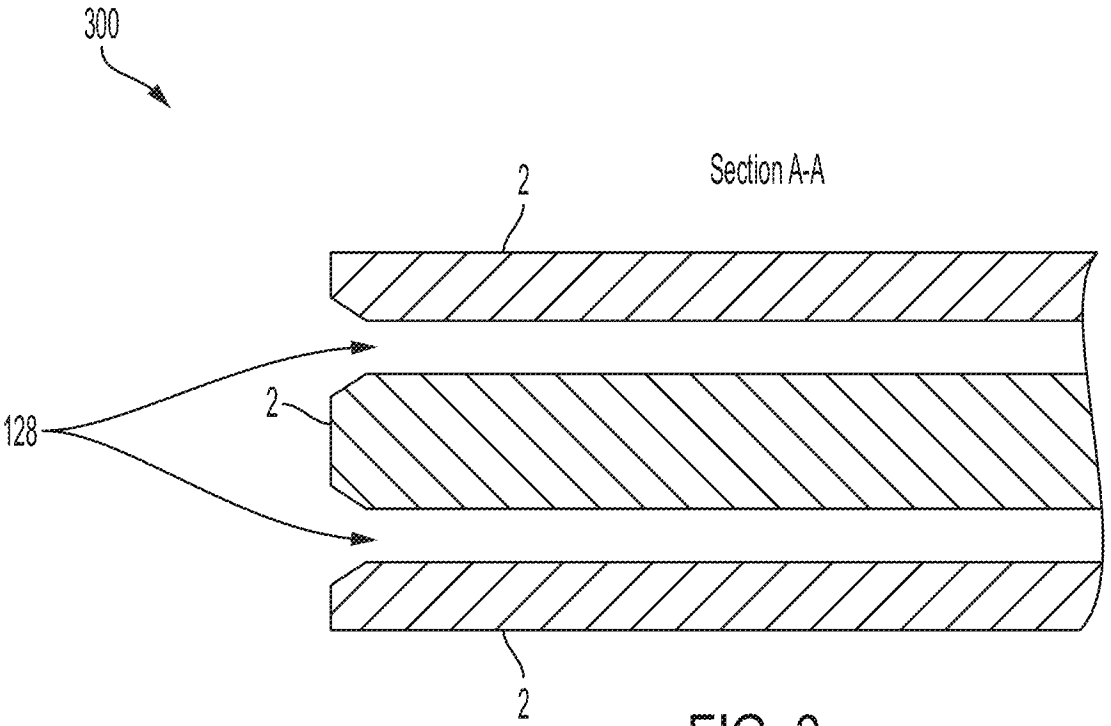
FIG. 3 illustrates an exemplary embodiment of a cross-sectional view of the insulating body of FIG. 1.

FIG. 3 illustrates an exemplary embodiment of a cross-sectional view 300 of a portion of the insulator body 2 of FIG. 1. The portion illustrated in FIG. 3 is the left-side of the insulator body as viewed in FIG. 1 an indicated by lines A-A. Insulator body 2 includes openings 128, which allow each of the electric pins 6 (shown in FIG. 1) and the electrical terminals 4 (shown in FIGS. 1 and 2) to establish an electrical connection in insulator body 2. As is evident from the section view of FIG. 3, the openings 128 are tapered at ends thereof relative to the size of the opening extending further to the right as viewed in FIG. 3. In some embodiments, the taper may be a 3-5 degree taper. In some embodiments, the taper may be a 4 degree taper. The openings 128 may be cylindrical in shape at the conclusion of the taper and extend in the X-axis direction. Upon assembly, the first set of projections 112 may be inserted and thereby coupled to the insulator body via insertion of the first set of projections 112 into corresponding openings 128 of the insulator body 2. Upon assembly of the electrical connector 100, the relatively straight profile of the first set of projections 112 thus seals against the tapered ends of the openings 128 to provide a desired mechanical seal. As the cable kit 7 is formed of rubber, assembly of the electrical connector 100 causes the rubber kit to expand into a sealing engagement with the insulator body 2. The seal formed by this arrangement protects the electrical connections discussed herein from external elements that can disrupt the operations of the electrical connector 100, such as fluid intrusion, gas intrusion, debris, or the like.

Figure 4:
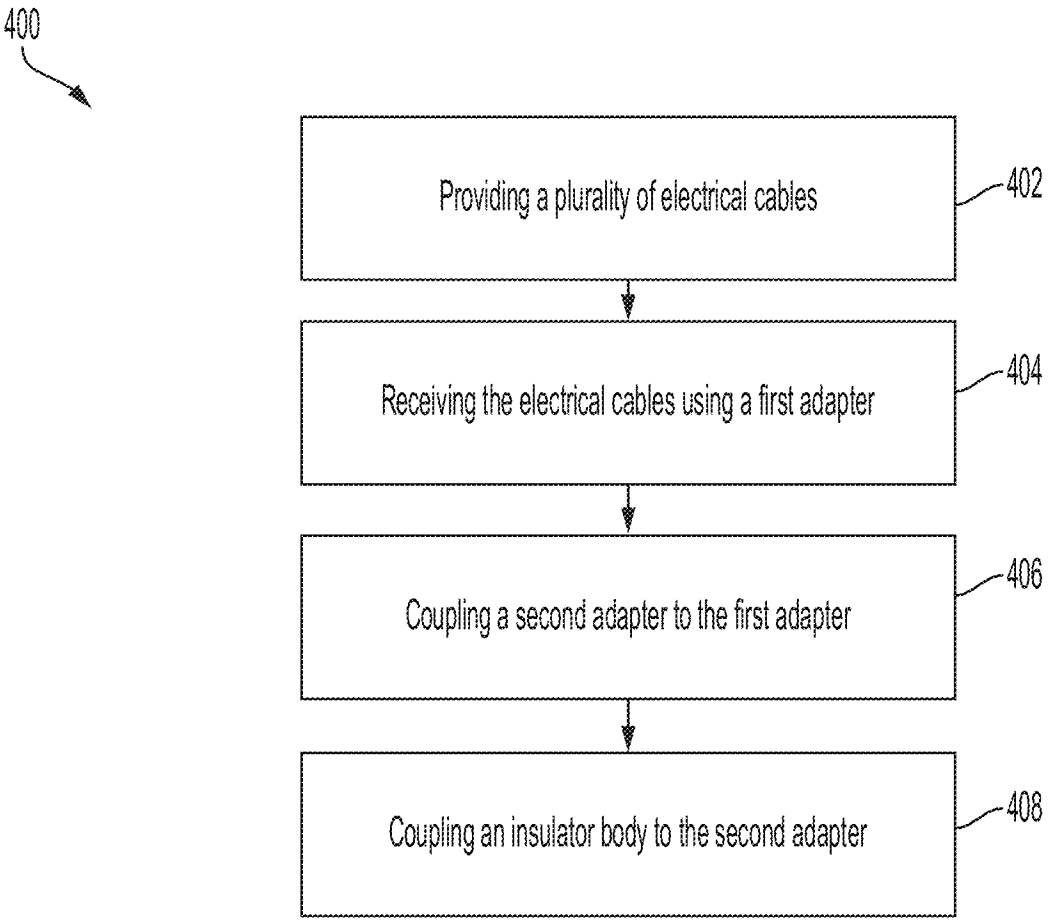
FIG. 4 is a process flow for a method of manufacturing an electrical connector, in accordance with some embodiments.

FIG. 4 is a process flow 400 for a method of manufacturing an electrical connector, in accordance with some embodiments. Process flow 400 may be used to manufacture electrical connector 100, as shown in FIGS. 1 and 2. The method includes providing a plurality of electrical cables, as shown in step 402. The electrical cables may include electrical cables 10, as shown in FIGS. 1 and 2. Also, the method includes receiving the electrical cables 10 using a first adapter, as shown in step 404. The first adapter protects the electrical cables 10 and allows for an electrical connection between the electrical cables and a plurality of electrical pins. The first adapter may include armor adapter 11, as shown in FIGS. 1. and 2. Also, the method includes coupling a second adapter to the first adapter, as shown in step 406. The second adapter allows for an electrical connection between the electrical pins and a plurality of electrical terminals. The second adapter may include the adapter 1, as shown in FIGS. 1 and 2. Moreover, the method includes coupling an insulator body to the second adapter, as shown in step 408. The insulator body has a cylindrical shape with a plurality of openings at both ends. The electrical terminals enter the insulator body at one end via a first set of openings of the plurality of openings and the electrical terminals exit the insulator body via a second set of openings of the plurality of openings. The insulator body may include insulator body 2, as shown in FIGS. 1 and 2.

As can be appreciated in view of the foregoing, the present disclosure is directed to an electrical connector for establishing subsea electrical connections and submersible pump electrical connections. In particular, the electrical connector may include an insulator body having a number of openings where each of the openings includes a taper. The cable kit described herein includes projections, which seal to the tapered ends of the insulator body upon assembly of the electrical connector. This results in a desired mechanical seal to protect the electrical connections described herein, which is an improvement over prior art electrical connectors that rely on downhole pressure to form the seal. The seal may protect the electrical connections in the electrical connector from harmful elements, such as fluid intrusion, gas intrusion, debris, or the like. Also, the electrical connector may be designed to handle the physical elements that deteriorate standard electrical connectors, such as high temperature, high pressure, and abrasive and/or corrosive fluids, including liquids and gases. Moreover, the compact design described in the disclosure allows the electrical connector to apply easily across multiple types of equipment, requiring subsea electrical connections and/or submersible pump electrical connections. In addition, the compact design arranges internal components of the electrical connector in a modular fashion allowing for easier access and interchangeability of the internal components of the electronic connector.

Finally, the above descriptions of the implementations of the present disclosure have been presented for the purposes of illustration and description. It is not intended to be exhaustive or to limit the present disclosure to the precise form disclosed. Many modifications and variations are possible in light of the above teaching. It is intended that the scope of the present disclosure be limited not by this detailed description, but rather by the claims of this application. As will be understood by those familiar with the art, the present disclosure may be embodied in other specific forms without departing from the spirit or essential characteristics thereof. Accordingly, the present disclosure is intended to be illustrative, but not limiting, of the scope of the present disclosure, which is set forth in the following claims.

What is claimed is:

1. An electrical connector, comprising:

a plurality of electrical cables;

a first adapter being configured to receive the electrical cables, wherein the first adapter protects the electrical cables and allows for an electrical connection between the electrical cables and a plurality of electrical pins;

a second adapter being coupled to the first adapter, the second adapter allowing for an electrical connection between the electrical pins and a plurality of electrical terminals within the second adapter;

a cable kit at least partially housed within the second adapter, the cable kit having a plurality of projections extending therefrom; and an insulator body being coupled to the second adapter, wherein the insulator body includes a plurality of openings, each of the openings having a tapered end portion configured to receive a corresponding one of the plurality of projections to form a mechanical seal with the cable kit.

2. The electrical connector of claim 1, wherein the first adapter comprises a first portion having an elliptical shape.

3. The electrical connector of claim 2, wherein the first portion receives the electrical cables via an opening.

4. The electrical connector of claim 1, wherein the second adapter is attached to a portion of the first adapter.

5. The electrical connector of claim 4, wherein the second adapter is attached to a portion of the insulator body.

6. The electrical connector of claim 1, wherein the electrical terminals are protected using a plurality of armored cables.

7. The electrical connector of claim 1, wherein the electrical pins and the electrical terminals are positioned within the insulator body.

8. The electrical connector of claim 1, wherein the insulator body includes O-rings disposed about the insulator body.

9. A method of manufacturing an electrical connector, comprising:

providing a plurality of electric cables;

receiving the electrical cables via a first adapter, wherein the first adapter protects the electrical cables and allows for an electrical connection between the electrical cables and a plurality of electrical pins;

coupling a second adapter to the first adapter, the second adapter allowing for an electrical connection between the electrical pins and a plurality of electrical terminals within the second adapter;

positioning a cable kit at least partially within the second adapter, the cable kit having a plurality of projections extending therefrom; and coupling an insulator body to the second adapter, the insulator body including a plurality openings, each of the openings having a tapered end portion to receive a corresponding one of the plurality of projections to form a mechanical seal.

10. The method of claim 9, wherein receiving the electrical cables via the first adapter includes providing the first adapter with a first portion having an elliptical shape for receiving the electrical cables.

11. The method of claim 9, wherein coupling the insulator body to the second adapter includes protecting the electrical terminals using a plurality of armored cables.

12. The method of claim 9, wherein coupling the insulator body to the second adapter includes positioning the electrical pins and the electrical terminals within the insulator body.

13. An electrical connector, comprising:

a plurality of electrical cables;

a first adapter being configured to receive the electrical cables, wherein the first adapter protects the electrical cables and allows for an electrical connection between the electrical cables and a plurality of electrical pins;

a second adapter being coupled to the first adapter, wherein the second adapter houses a cable kit further allowing for the electrical connection between the electrical pins and the electrical cables within the second adapter, the cable kit including a plurality of projections extending therefrom; and an insulator body at least partially positioned within the second adapter, the insulator body having a plurality of openings at a first end thereof, each of the openings having a tapered end portion configured to receive a corresponding one of the plurality of projections to form a mechanical seal with the cable kit;

wherein each of the plurality of projections are substantially constant in diameter; wherein the insulator body is substantially cylindrical in shape and includes a plurality of openings defined at a second end thereof; and second adapter is configured to allow for an electrical connection.

* * * * *